US006845903B2

(12) United States Patent
Yang

(10) Patent No.: US 6,845,903 B2
(45) Date of Patent: Jan. 25, 2005

(54) STACKABLE & FOLDABLE PAPERBOARD FILE TRAY

(76) Inventor: David Yang, Moraga Rd., Moraga, CA (US) 94556

( * ) Notice: Subject to any disclaimer, the term of this patent is extended or adjusted under 35 U.S.C. 154(b) by 338 days.

(21) Appl. No.: 10/059,402

(22) Filed: Jan. 31, 2002

(65) Prior Publication Data

US 2003/0168504 A1 Sep. 11, 2003

(51) Int. Cl.[7] ..... B65D 5/20

(52) U.S. Cl. ..... 229/167; 229/122.34; 229/141; 229/178

(58) Field of Search ..... 229/122.34, 141, 229/161, 167, 168, 178

(56) References Cited

U.S. PATENT DOCUMENTS 2,912,154 A * 11/1959 Doran ..... 229/161
3,401,865 A * 9/1968 Holstrom ..... 229/167
3,905,543 A * 9/1975 Randles ..... 229/167
4,034,908 A * 7/1977 Forbes, Jr. et al. ..... 229/167
4,361,265 A * 11/1982 Benham ..... 229/167
4,371,366 A * 2/1983 Bower et al. ..... 229/178
5,277,360 A * 1/1994 DeMott ..... 229/167
5,361,975 A * 11/1994 Droste et al. ..... 229/168
5,661,879 A * 9/1997 Kelly ..... 229/167
6,345,758 B2 * 2/2002 Jaggi ..... 229/178

FOREIGN PATENT DOCUMENTS

JP 5-162741 A * 6/1993 ..... 229/167

* cited by examiner

*Primary Examiner*—Gary E. Elkins

(57) ABSTRACT

The present invention is directed to a folder type file tray assembled from a single paperboard blank. The file tray can be flattened to a reduced size during storage or transportation. It can also be assembled into different forms for different usage. The first form of file tray is an open-top box with a front opening for usage as a conventional file tray. The second form of file tray is an open-top box without a front opening, i.e., surrounded by four side walls for usage as a desk-top tool box. The third form of file tray is an open-top box with a foldable closing lid for usage such as a storage box. Additionally, the file tray of present invention can be stacked up directly to each other in multiple numbers without additional means of support. The file tray of present invention has low material and manufacturing costs. If needed, one side of paper blank can be laminated with higher quality paper or decorative material to enhance the appearance of file tray of present invention.

6 Claims, 5 Drawing Sheets

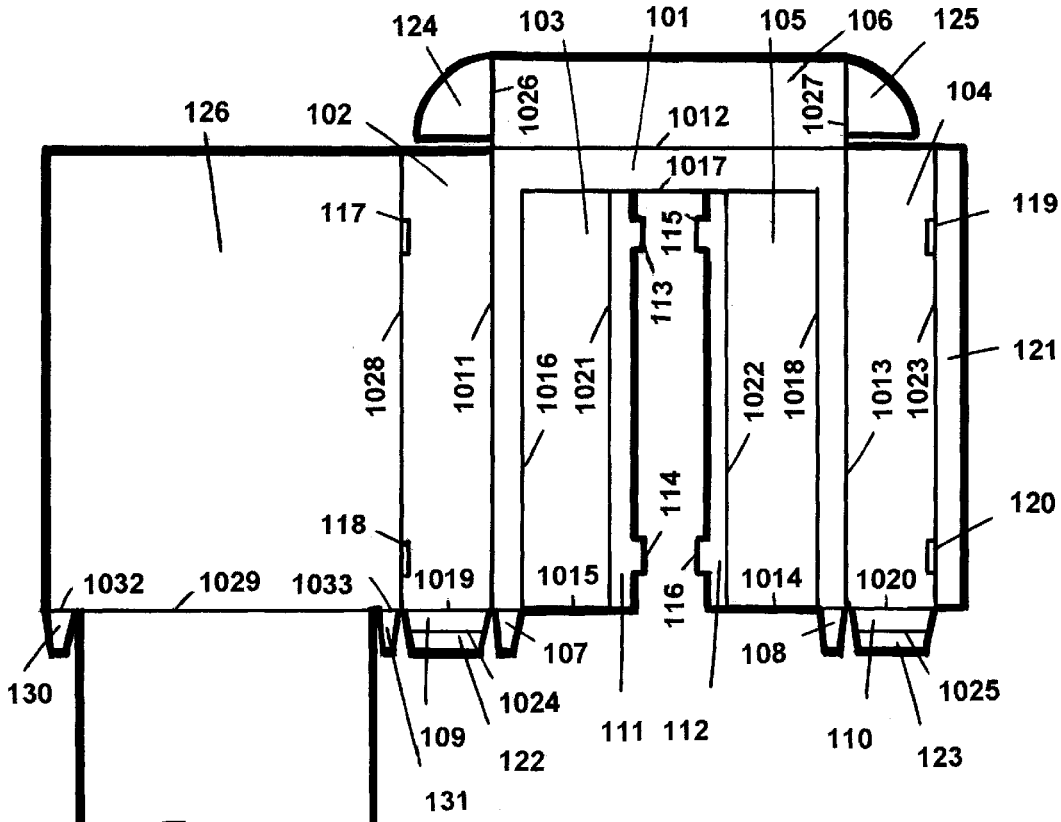
FIG. 1
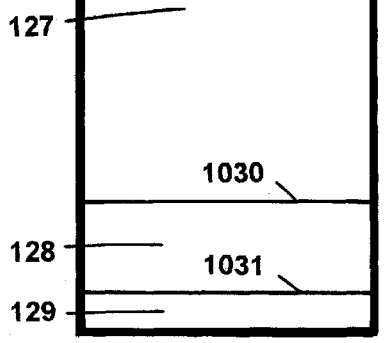
FIG. 4
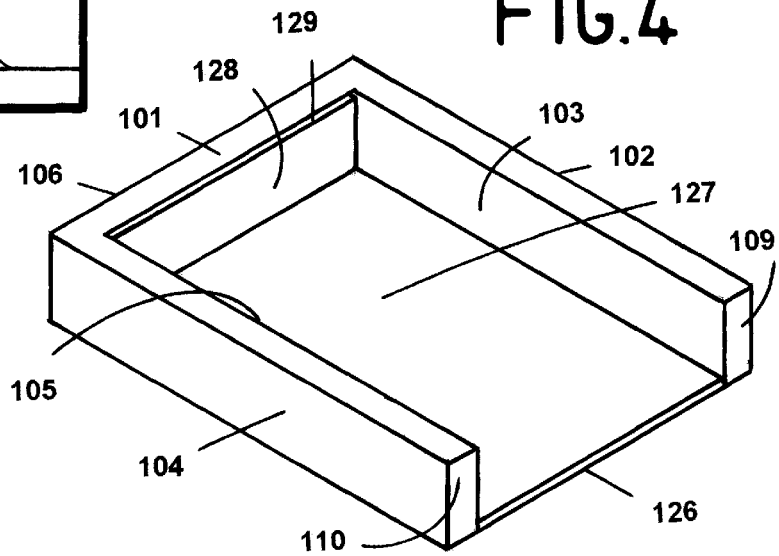

STACKABLE & FOLDABLE PAPERBOARD FILE TRAY

DESCRIPTION OF THE BACKGROUND

A file tray is commonly used for receiving, storing, sorting or organizing files, documents, mails, . . . etc. A simple file tray can be an open-top box made of metal, wood, plastic or paperboard. A disadvantage of such a file tray with a permanent structure is that it must occupy an equal space during usage and non-usage (ie., transportation or storage.) Another disadvantage is that it normally requires additional means of support to stack up to each other.

In some applications, multiple file trays are constructed within a structure, which is divided into a fixed number of rows and columns of trays by internal partitions. The disadvantage of such arrangement is that user can not alter the size of entire structure or the number of trays for usage.

The present invention is directed to a one piece, cut and scored paperboard blank so that it is ready to be folded into a folder type file tray. Therefore, it can be flattened to a reduced size during transportation and storage. The present invention is also directed to the structure of file tray so that individual file tray can be directly stacked up to each other without additional means of support.

Various styles and shapes of folder type paperboard boxes have been disclosed in the prior art for usage in packaging, food and beverage industries. For example, U.S. Pat. No. 5,839,649 disclosed a trapezoidal paper box with inner partitions made from a single paperboard blank. U.S. Pat. No. 5,183,200 disclosed a folder type paper box that can be assembled by bonding only one face in assembly. U.S. Pat. No. 4,109,786 disclosed a folder type paper box to hold round cylindrical articles in an angular position. U.S. Pat. No. 3,935,992 disclosed a folder type paper box with dual functions of a container and an open receptacle. U.S. Pat. No. 2,237,706 disclosed a display basket for toilet articles made from a single paperboard blank. However, none of prior art of folder type paper box can serve the unique purpose of the file tray of present invention.

SUMMARY OF THE INVENTION

The file tray of present invention is a folder type file tray made of a single paperboard blank. One object of present invention is to allow the file tray to be flattened to a reduced size during storage and transportation. Another object of present invention is to allow the file tray to be stacked up to each other without additional means of support when multiple trays are used. Another object of present invention is to allow the file tray to be assembled into different forms for different usage. For example, the first form of file tray is an open-top box with a front opening, or a conventional file tray where files are accessed through either top opening or front opening. The second form of file tray is an open-top box without a front opening, or an open container or storage box for usage such as a desk-top tool box The third form of file tray is an open-top box with a foldable closing lid, or a covered storage box. The appearance of file tray of present invention can be enhanced by laminating higher quality paper or decorative material on one side of paperboard blank.

BRIEF DESCRIPTION OF THE DRAWING

FIG. 1 is a top view of the first preferred embodiment of present invention, a one-piece foldable paper blank cut and scored so that it can be folded into a file tray as shown in FIG. 4.

FIG. 4 is a perspective view of file tray assembled from the first preferred embodiment of present invention shown in FIG. 1., in which the bottom tray consists of double layers of paperboards.

DETAILED DESCRIPTION OF THE PREFERRED EMBODIMENT

Figure 2:
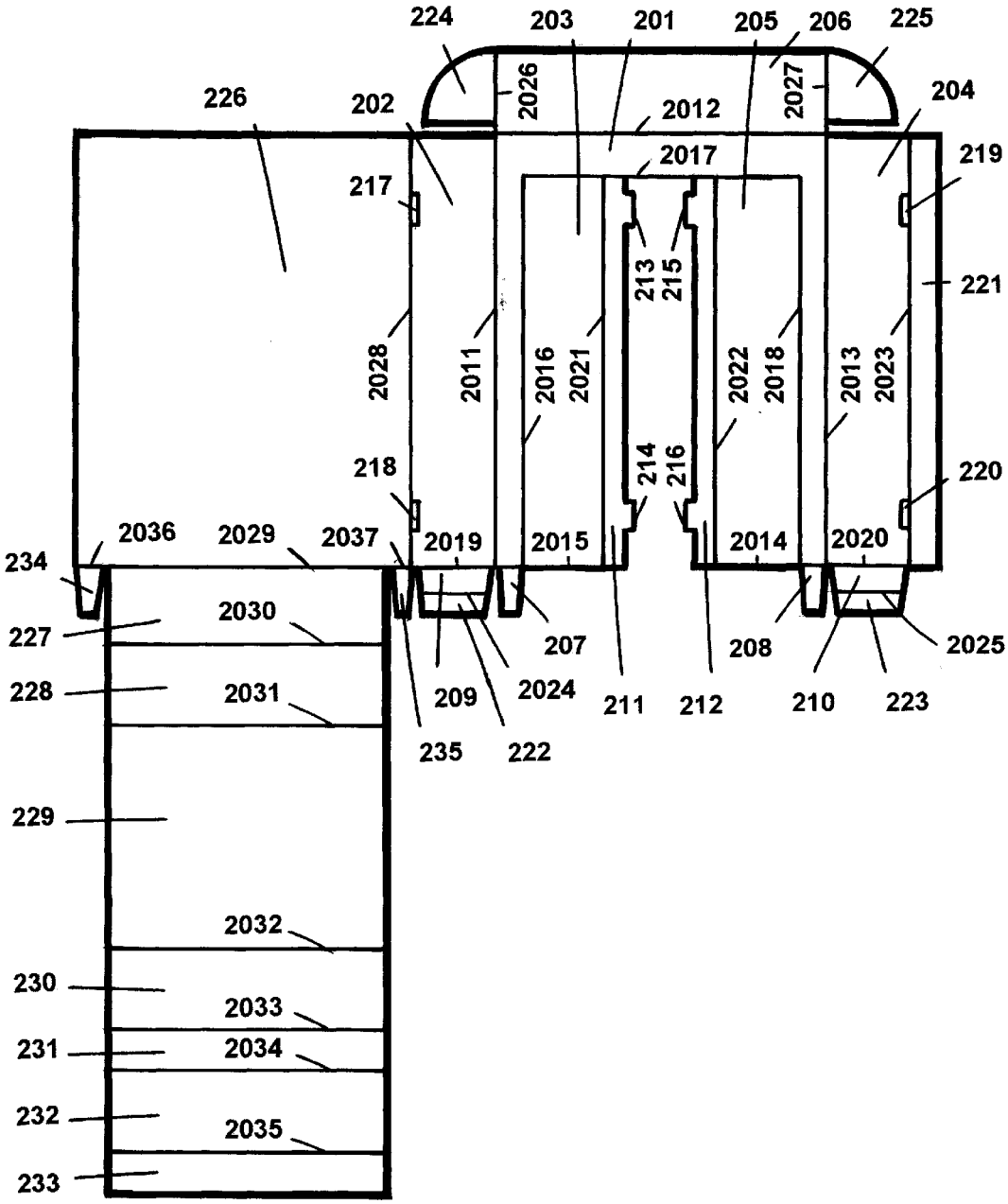
FIG. 2 is a top view of the second preferred embodiment of present invention, a one-piece foldable paper blank cut and scored so that it can be folded into multiple forms as shown in FIG. 5, FIG. 6 and FIG. 7.

FIG. 1 represents the one-piece foldable paper blank of the first preferred embodiment of present invention. The U-shape top panel 101 consists of three legs: left leg, back leg and right leg. Top panel 101 has five outer sides 1011 through 1015, and three inner sides 1016 through 1018. With exception of inner side 1017, all outer and inner sides of top panel 101 are scored as fold lines as follows: the outer side wall panel 102 of the right leg being extended from top panel 101 with a fold line 1011; the inner side wall panel 103 of the right leg being extended from top panel 101 with a fold line 1016; the outer side wall panel 104 of the left leg being extended from top panel 101 with a fold line 1013; the inner side wall panel 105 of the lef leg being extended from top panel 101 with a fold line 1018; the back wall panel 106 of the back leg being extended from top panel 101 with a fold line 1012; the first closing flap 107 of right leg being extended from top panel 101 with a fold line 1015; the first closing flap 108 of left leg being extended from top panel 101 with a fold line 1014.

The front wall panel 109 of the right leg is extended from side wall panel 102 with a fold line 1019. The front wall panel 110 of the left leg is extended from side wall panel 104 with a fold line 1020. The second closing flap 111 of right leg is extended from side wall panel 103 with a fold line 1021. The second closing flap 112 of left leg is extended from side wall panel 105 with a fold line 1022. The closing flap 111 has two tabs 113 and 114 for engaging into holes 117 and 118 respectively during assembling. The closing flap 112 has two tabs 115 and 116 for engaging into holes 119 and 120 respectively during assembling. The third closing flap 121 of left leg is extended from side wall panel 104 with a fold line 1023. The bottom surface of closing flap 121 is applied with glue. The third closing flap 122 of right leg is extended from front wall panel 109 of right leg with a fold line 1024. The fourth closing flap 123 of left leg is extended from front wall panel 110 of left leg with a fold line 1025. The first and second closing flaps 124 and 125 of back leg are extended from the outside wall panel 106 of back leg with a fold line 1026 and 1027 respectively.

The first bottom panel 126 is extended from side wall 102 with a fold line 1028. The second bottom panel 127 is extended from the first bottom panel 126 with a fold line 1029. The second bottom panel 127 is folded over the top of the first bottom panel 126 during assembling. The front wall panel 128 of back leg is extended from bottom panel 127 with a fold line 1030. The third closing flap 129 of back leg is extended from wall panel 128 with a fold line 1031. The fifth closing flap 130 of left leg is extended from bottom panel 126 with a fold line 1032. The fourth closing flap 131 of right leg is extended from bottom panel 126 with a fold line 1033.

FIG. 2 represents the one-piece foldable paper blank of the second preferred embodiment of present invention. The U-shape top panel 201 consists of three legs: left leg, back leg and right leg. Top panel 201 has five outer sides 2011 through 2015, and three inner sides 2016 through 2018. With exception of inner side 2017, all outer and inner sides of top panel 201 are scored as fold lines as follows: the outer side wall panel 202 of the right leg being extended from top panel 201 with a fold line 2011; the inner side wall panel 203 of the right leg being extended from top panel 201 with a fold line 2016; the outer side wall panel 204 of the left leg being extended from top panel 201 with a fold line 2013; the inner side wall panel 205 of the left leg being extended from top panel 201 with a fold line 2018; the back wall panel 206 of the back leg being extended from top panel 201 with a fold line 2012; the first closing flap 207 of right leg being extended from top panel 201 with a fold line 2015; the first closing flap 208 of left leg being extended from top panel 201 with a fold line 2014.

The front wall panel 209 of the right leg is extended from side wall panel 202 with a fold line 2019. The front wall panel 210 of the left leg is extended from side wall panel 204 with a fold line 2020. The second closing flap 211 of right leg is extended from side wall panel 203 with a fold line 2021. The second closing flap 212 of left leg is extended from side wall panel 205 with a fold line 2022. The closing flap 211 has two tabs 213 and 214 for engaging into holes 217 and 218 respectively during assembling. The closing flap 212 has two tabs 215 and 216 for engaging into holes 219 and 220 respectively during assembling. The third closing flap 221 of left leg is extended from side wall panel 204 with a fold line 2023. The bottom surface of closing flap 221 is applied with glue. The third closing flap 222 of right leg is extended from front wall panel 209 of right leg with a fold line 2024. The fourth closing flap 223 of left leg is extended from front wall panel 210 of left leg with a fold line 2025. The first and second closing flaps 224 and 225 of back leg are extended from the outside wall panel 206 of back leg with a fold line 2026 and 2027 respectively.

The first bottom panel 226 is extended from side wall 202 with a fold line 2028. Panel 227 is extended from the first bottom panel 226 with a fold line 2029. Panel 228 is extended from the panel 227 with a fold line 2030. Panel 229 is extended from the panel 228 with a fold line 2031. Panel 230 is extended from the panel 229 with a fold line 2032. Panel 231 is extended from the panel 230 with a fold line 2033. Panel 232 is extended from the panel 231 with a fold line 2034. Panel 233 is extended from the panel 232 with a fold line 2035. The fifth closing flap 234 of left leg is extended from bottom panel 226 with a fold line 2036. The fourth closing flap 235 of right leg is extended from bottom panel 226 with a fold line 2037.

Figure 5:
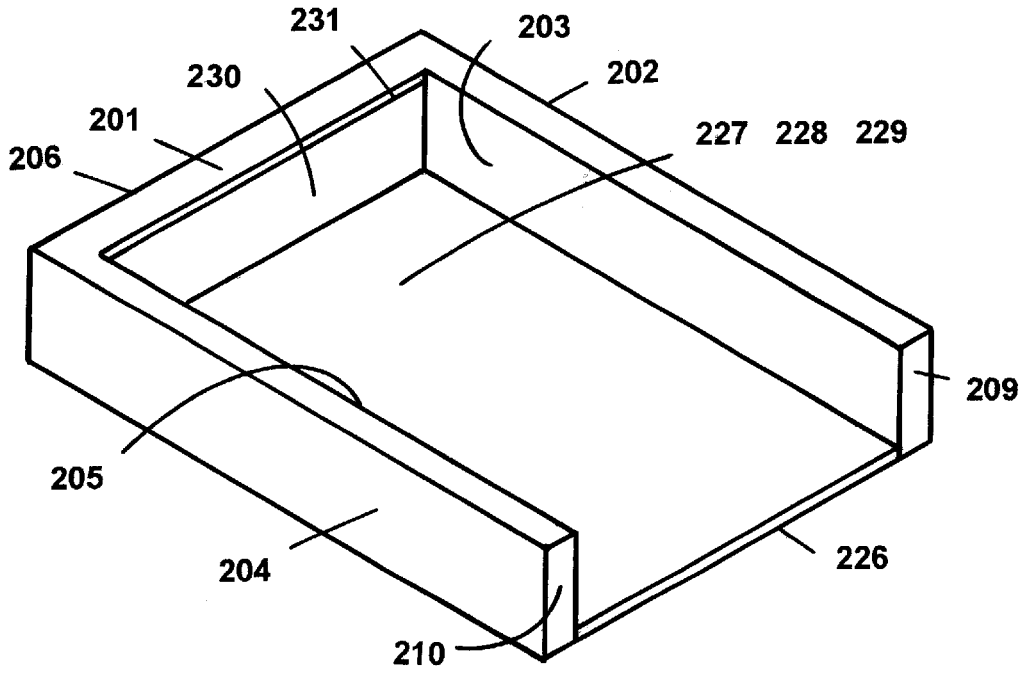
FIG. 5 is a perspective view of the first form of file tray assembled from the second preferred embodiment of present invention shown in FIG. 2, in which the bottom tray consists of double layers of paperboards.
Figure 6:
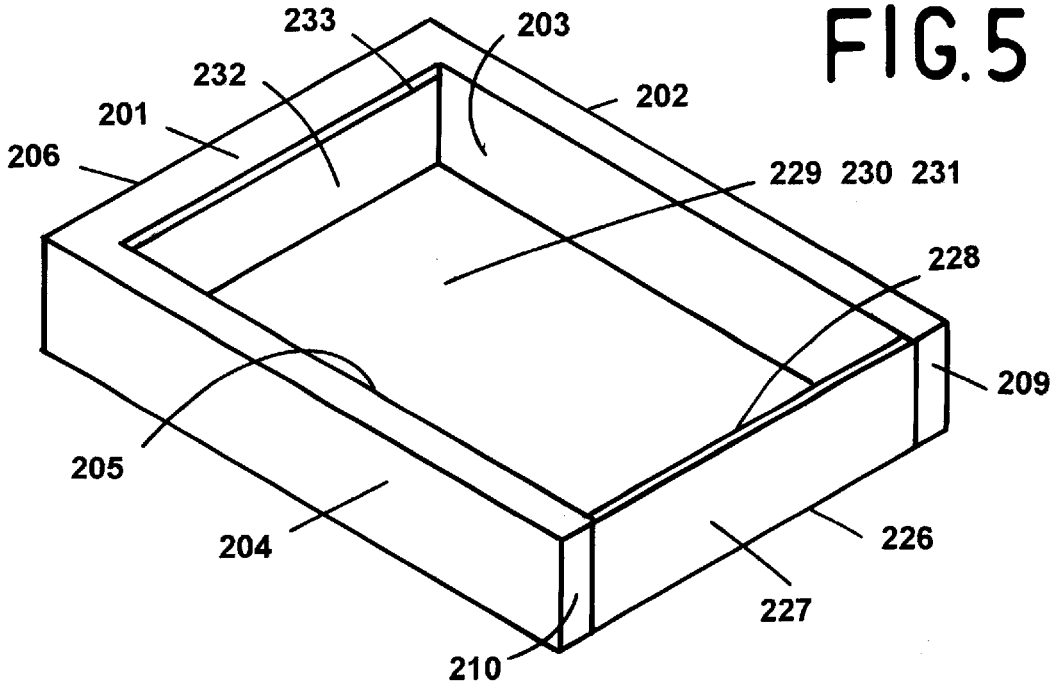
FIG. 6 is a perspective view of the second form of file tray assembled from the second preferred embodiment of present invention shown in FIG. 2, in which the bottom tray consists of double layers of paperboards, and is surrounded by four side walls.
Figure 7:
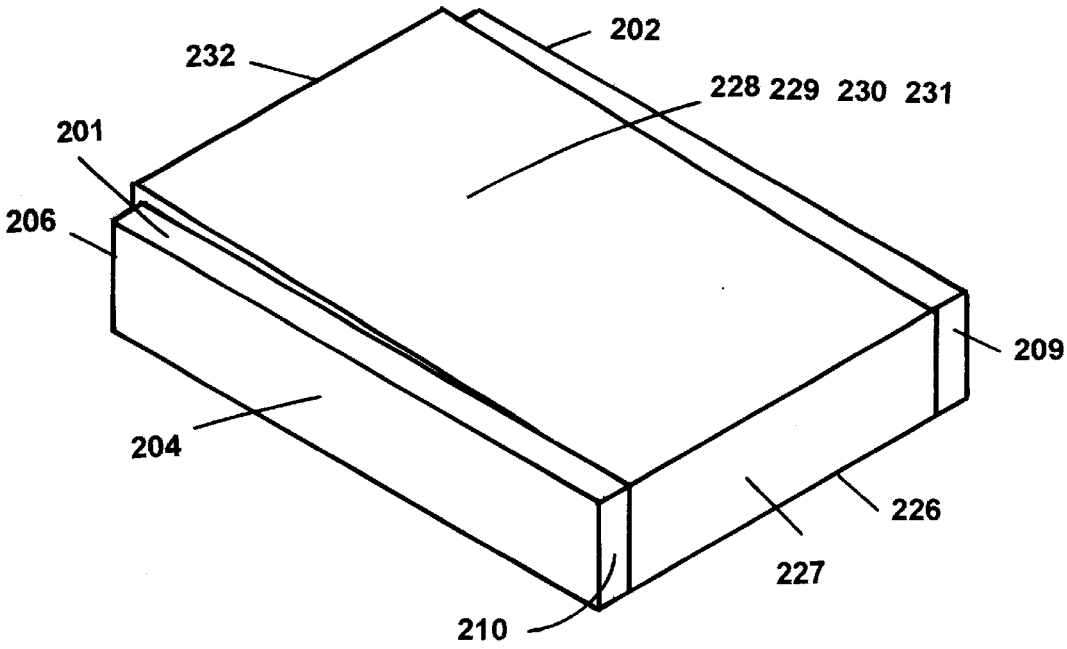
FIG. 7 is a perspective view of the third form of file tray assembled from the second preferred embodiment of present invention shown in FIG. 2, in which a single layer of bottom tray is extended for use as a foldable cover.

Panels 227 through 233 are properly sized so that they can be folded to create three different forms of a file tray as shown in FIG. 5, FIG. 6 and FIG. 7.

To create a file tray in the form as shown in FIG. 5, Panels 227 through 233 are folded as follows: Panels 227, 228 and 229 are integrated into a single panel as a second bottom panel, which is folded along fold line 2029 and over the top of first bottom panel 226. Panel 230 is folded along fold line 2032 vertically to serve as a front wall of back leg. Panels 231, 232 and 233 are folded along fold lines 2033, 2034 and 2035 respectively to serve as the third, forth and fifth closing flap of back leg respectively.

To create a file tray in the form as shown in FIG. 6, Panels 227 through 233 are folded as follows: Panel 227 is folded upward along fold line 2029 to serve as a front panel of front wall. Panel 228 is folded downward along fold line 2030 to serve as a back panel of front wall. Panels 229, 230 and 231 are integrated into a single panel as a second bottom panel, which is folded over the top of first bottom panel 226. Panel 232 is folded upward along fold-line 2034 to serve as a front wall of back leg. Panel 233 is folded along fold line 2035 to serve as the third closing flap of back leg.

To create a file tray in the form as shown in FIG. 7, Panels 227 through 233 are folded as follows: Panel 227 is folded upward along fold line 2029 to serve as a front panel of closing lid. Panels 228 through 231 are integrated into a single panel as a top panel of closing lid, which is folded over the top of back leg along fold line 2030. Panel 232 is folded downward along fold line 2034 to serve as a second back wall of back leg. Panel 233 is folded along fold line 2035 to serve as a third closing flap of back leg.

Figure 3:
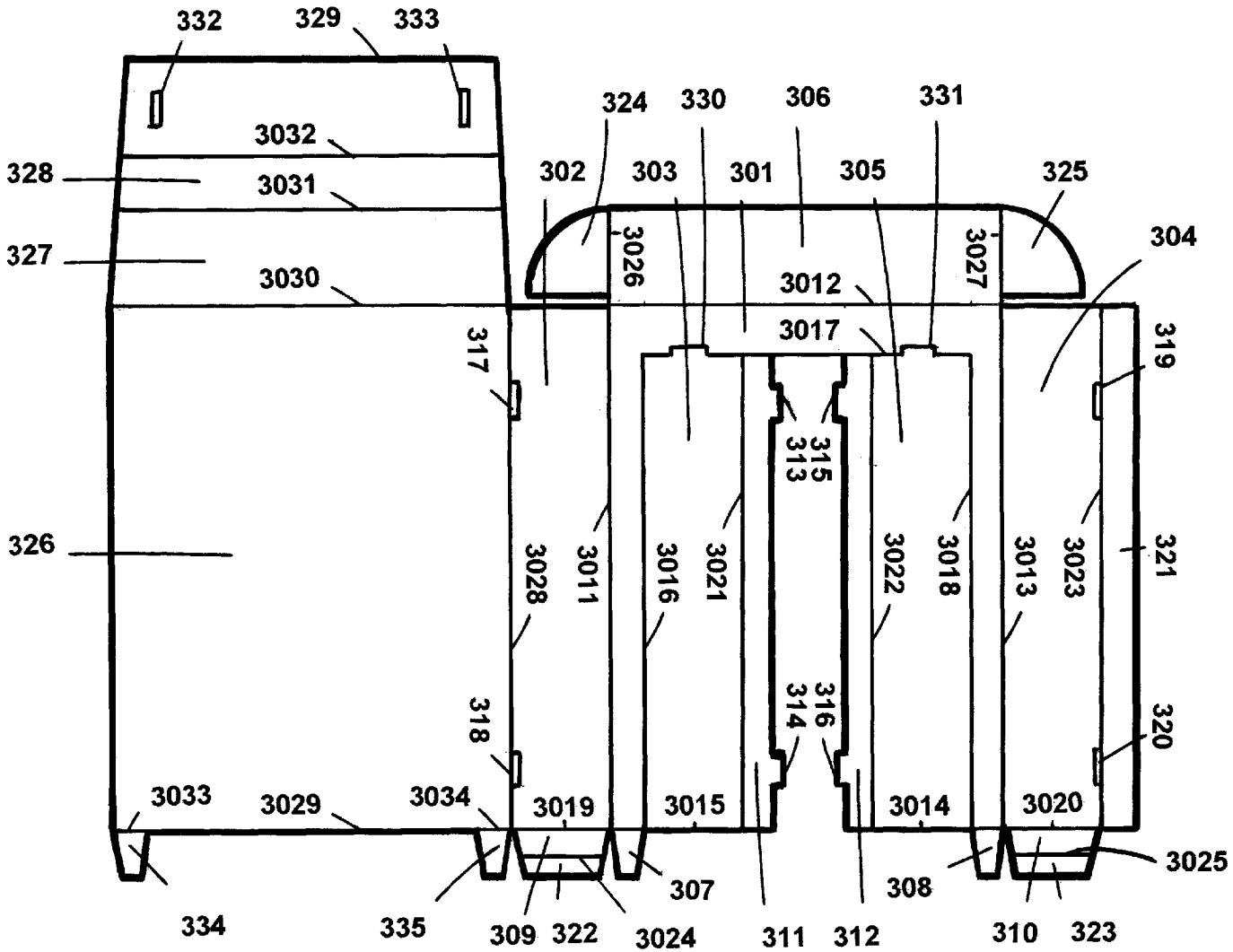
FIG. 3 is a top view of the third preferred embodiment of present invention, a one-piece foldable paper blank cut and scored so that it can be folded into a file tray as shown in FIG. 8.

FIG. 3 represents the one-piece foldable paper blank of the third preferred embodiment of present invention. The U-shape top panel 301 consists of three legs: left leg, back leg and right leg. Top panel 301 has five outer sides 3011 through 3015, and three inner sides 3016 through 3018. With exception of inner side 3017, all outer and inner sides of top panel 301 are scored as fold lines as follows: the outer side wall panel 302 of the right leg being extended from top panel 301 with a fold line 3011; the inner side wall panel 303 of the right leg being extended from top panel 301 with a fold line 3016; the outer side wall panel 304 of the left leg being extended from top panel 301 with a fold line 3013; the inner side wall panel 305 of the left leg being extended from top panel 301 with a fold line 3018; the first back wall panel 306 of the back leg being extended from top panel 301 with a fold line 3012; the first closing flap 307 of right leg being extended from top panel 301 with a fold line 3015; the first closing flap 308 of left leg being extended from top panel 301 with a fold line 3014.

The front wall panel 309 of the right leg is extended from side wall panel 302 with a fold line 3019. The front wall panel 310 of the left leg is extended from side wall panel 304 with a fold line 3020. The second closing flap 311 of right leg is extended from side wall panel 303 with a fold line 3021. The second closing flap 312 of left leg is extended from side wall panel 305 with a fold line 3022. The closing flap 311 has two tabs 313 and 314 for engaging into holes 317 and 318 respectively during assembling. The closing flap 312 has two tabs 315 and 316 for engaging into holes 319 and 320 respectively during assembling. The third closing flap 321 of left leg is extended from side wall panel 304 with a fold line 3023. The bottom surface of closing flap 321 is applied with glue. The third closing flap 322 of right leg is extended from front wall panel 309 of right leg with a fold line 3024. The fourth closing flap 323 of left leg is extended from front wall panel 310 of left leg with a fold line 3025. The first and second closing flaps 324 and 325 of back leg are extended from the first back wall panel 306 of back leg with a fold line 3026 and 3027 respectively.

The bottom panel 326 is extended from side wall 302 with a fold line 3028. The second back wall panel 327 of back leg is extended from bottom panel 326 with a fold line 3030. The second top panel 328 of back leg is extended from panel 327 with a fold line 3031. The front wall panel 329 of back leg is extended from panel 328 with a fold line 3032. The front wall panel 329 of back leg has two holes 332 and 333 for engaging tabs 331 and 330 respectively. The fifth closing flap 334 of left leg is extended from bottom panel 326 with a fold line 3033. The fourth closing flap 335 of right leg is extended from bottom panel 326 with a fold line 3034.

FIG. 4 is a perspective view of a file tray in the final form folded and assembled from the first preferred embodiment of paper blank of the invention. Such a file tray is in the form of an open-top box with a front opening. Each panel number as shown in FIG. 4 corresponds to that of the first preferred embodiment of paper blank as shown in FIG. 1.

FIG. 5 is a perspective view of the first form of a file tray folded and assembled from the second preferred embodiment of paper blank of the invention. Such a file tray is in the form of an open-top box with a front opening, which is identical to that of FIG. 4. Each panel number as shown in FIG. 5 corresponds to that of the second preferred embodiment of paper blank as shown in FIG. 2.

FIG. 6 is a perspective view of the second form of a file tray folded and assembled from the second preferred embodiment of paper blank of the invention. Such a file tray is in the form of an open-top box with a front wall Each panel number as shown in FIG. 6 corresponds to that of the second preferred embodiment of paper blank as shown in FIG. 2.

FIG. 7 is a perspective view of the third form of a file tray folded and assembled from the second preferred embodiment of paper blank of the invention. Such a file tray is in the form of a closing-top box with a foldable closing lid. Each panel number as shown in FIG. 7 corresponds to that of the second preferred embodiment of paper blank as shown in FIG. 2.

Figure 8:
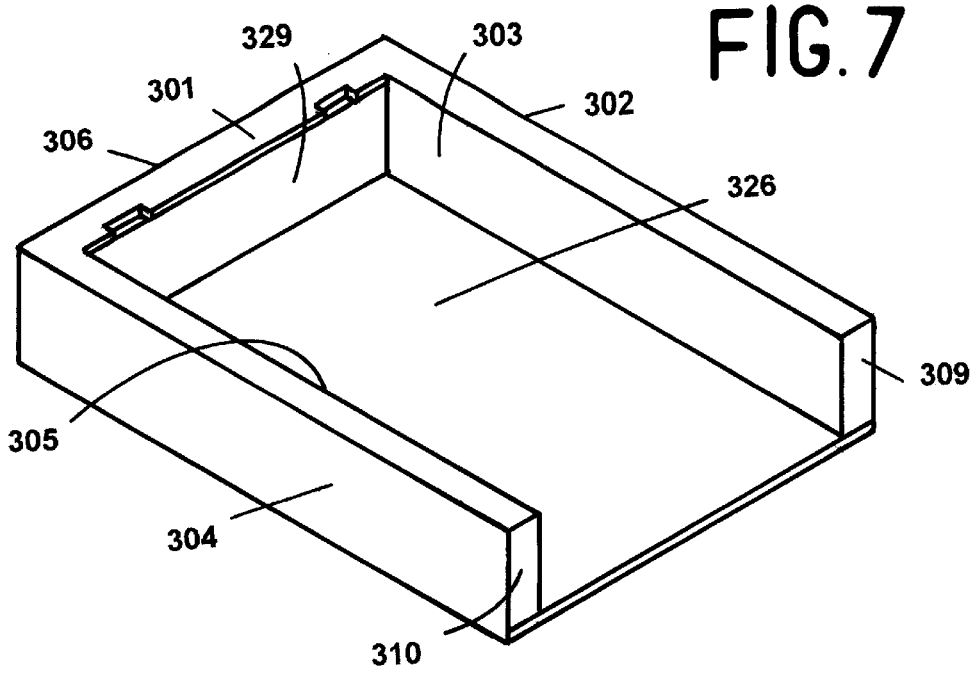
FIG. 8 is a perspective view of file tray assembled from the third preferred embodiment of present invention, having a single layer of paperboard at the bottom of tray.

FIG. 8 is a perspective view of a file tray in the final form folded and assembled from the third preferred embodiment of paper blank of the invention. Such a file tray is in the form of an open-top box with a front opening, which is similar but not identical to that of FIG. 4 or FIG. 5. The file tray of FIG. 8 has a single bottom panel, but the file tray of FIG. 4 or FIG. 5 has double bottom panels. The selection of a file tray with a single bottom panel or double bottom panels may depend on the material strength and thickness of paper blank. When one side of paper blank is laminated with decorative material for enhancing the appearance of file tray, a file tray of double bottom panels is more desirable so that only the decorative side of paper blank is visible (ie., the top surface of bottom panel).

What is claimed:

1. A one piece paper blank cut and scored so that it is divided into a series of connected wall forming panels, which are transformed into a file tray having at least a right leg, a back leg, a left leg, and a bottom tray, wherein the blank comprises:

(a) a U-shape wall panel forming a top panel having a first section of top panel covering said right leg, a second section of top panel covering back leg, and a third section of top panel covering left leg; said first section of top panel covering right leg having a front side, an outer side, and an inner side; said second section of top panel covering back leg having a front side, and a back side; said third section of top panel covering left leg having a front side, an outer side, and an inner side;

(b) a right outer side wall panel extending from said outer side of said first section of top panel covering right leg with a fold line in between;

(c) a right inner side wall panel extending from said inner side of said first section of top panel covering said right leg with a fold line in between, including a closing flap foldably connected to said right outer side wall panel for closing the bottom of said right leg;

(d) a right front side wall panel extending from a front side of said right outer side wall panel with a fold line in between, including a closing flap foldably connected to said right inner side wall panel;

(e) a first right front closing flap extending from said front side of said first section of top panel covering right leg with a fold line in between;

(f) a left outer side wall panel extending from said outer side of said third section of top panel covering left leg with a fold line in between, including a closing flap applied with glue and foldably connected to said bottom tray;

(g) a left inner side wall panel extending from said inner side of said third section of top panel covering left leg with a fold line in between, including a closing flap foldably connected to said left outer side wall panel for closing the bottom of said left leg;

(h) a left front side wall panel extending from a front side of said left outer side wall panel with a fold line in between, including a closing flap foldably connected to said left inner side wall panel;

(i) a first left front closing flap extending from said front side of said third section of top panel covering left leg with a fold line in between;

(j) a back side wall panel extending from said back side of said second section of top panel covering back leg with a fold line in between, including a first closing flap and a second closing flap foldably connected to said bottom tray;

(k) a first bottom panel of said bottom tray extending from a bottom side of said right outer side wall panel, including a second right front closing flap and a second left front closing flap;

(l) a second bottom panel of said bottom tray extending from a front side of said first bottom panel of said bottom tray with a fold line in between, foldably over-lapped on top of said first bottom panel of said bottom tray;

(m) a front side wall panel of said back leg extending from said second bottom panel of said bottom tray with a fold line in between, including a closing flap foldably connected under said second section of said top panel covering said back leg.

2. A one piece paper blank cut and scored so that it is divided into a series of connected wall forming panels, which are transformed into a file tray having at least a right leg, a back leg, a left leg, and a bottom tray, wherein the blank comprises:

(a) a U-shape wall panel forming a top panel having a first section of top panel covering said right leg, a second section of top panel covering back leg, and a third section of top panel covering left leg; said first section of top panel covering right leg having a front side, an outer side, and an inner side; said second section of top panel covering back leg having a front side, and a back side; said third section of top panel covering left leg having a front side, an outer side, and an inner side;

(b) a right outer side wall panel extending from said outer side of said first section of top panel covering right leg with a fold line in between;

(c) a right inner side wall panel extending from said inner side of said first section of top panel covering said right leg with a fold line in between, including a closing flap foldably connected to said right outer side wall panel for closing the bottom of said right leg;

(d) a right front side wall panel extending from a front side of said right outer side wall panel with a fold line in between, including a closing flap foldably connected to said right inner side wall panel;

(e) a first right front closing flap extending from said front side of said first section of top panel covering right leg with a fold line in between;

(f) a left outer side wall panel extending from said outer side of said third section of top panel covering left leg with a fold line in between, including a closing flap applied with glue and foldably connected to said bottom tray;

(g) a left inner side wall panel extending from said inner side of said third section of top panel covering left leg with a fold line in between, including a closing flap foldably connected to said left outer side wall panel for closing the bottom of said left leg;

(h) a left front side wall panel extending from a front side of said left outer side wall panel with a fold line in between, including a closing flap foldably connected to said left inner side wall panel;

(i) a first left front closing flap extending from said front side of said third section of top panel covering left leg with a fold line in between;

(j) a first back side wall panel extending from said back side of said second section of top panel covering back leg with a fold line in between, including a first closing flap and a second closing flap foldably connected to said bottom tray;

(k) a bottom panel forming said bottom tray extending from a bottom side of said right outer side wall panel, including a second right front closing flap and a second left front closing flap;

(l) a second back side wall panel extending from a back side of said bottom panel with a fold line in between;

(m) a second top panel extending from said second back side wall panel with a fold line in between, foldably connected under said second section of top panel covering back leg;

(n) a front side wall panel of said back leg extending from second top panel with a fold line in between.

3. A one piece paper blank cut and scored so that it is divided into a series of connected wall forming panels, which are transformed into a file tray having at least a right leg, a back leg, a left leg, and a bottom tray, wherein the blank comprises:

(a) a U-shape wall panel forming a top panel having a first section of top panel covering said right leg, a second section of top panel covering back leg, and a third section of top panel covering left leg; said first section of top panel covering right leg having a front side, an outer side, and an inner side; said second section of top panel covering back leg having a front side, and a back side; said third section of top panel covering left leg having a front side, an outer side, and an inner side;

(b) a right outer side wall panel extending from said outer side of said first section of top panel covering right leg with a fold line in between;

(c) a right inner side wall panel extending from said inner side of said first section of top panel covering said right leg with a fold line in between, including a closing flap foldably connected to said right outer side wall panel for closing the bottom of said right leg;

(d) a right front side wall panel extending from a front side of said right outer side wall panel with a fold line in between, including a closing flap foldably connected to said right inner side wall panel;

(e) a first right front closing flap extending from said front side of said first section of top panel covering right leg with a fold line in between;

(f) a left outer side wall panel extending from said outer side of said third section of top panel covering left leg with a fold line in between, including a closing flap applied with glue and foldably connected to said bottom tray;

(g) a left inner side wall panel extending from said inner side of said third section of top panel covering left leg with a fold line in between, including a closing flap foldably connected to said left outer side wall panel for closing the bottom of said left leg;

(h) a left front side wall panel extending from a front side of said left outer side wall panel with a fold line in between, including a closing flap foldably connected to said left inner side wall panel;

(i) a first left front closing flap extending from said front side of said third section of top panel covering left leg with a fold line in between;

(j)a back side wall panel extending from said back side of said second section of top panel covering back leg with a fold line in between, including a first closing flap and a second closing flap foldably connected to said bottom tray;

(k) a first bottom panel of said bottom tray extending from a bottom side of said right outer side wall panel, including a second right front closing flap and a second left front closing flap;

(l) a series of first, second, third, fourth, fifth and sixth interchangeable panels with a fold line in between.

4. The one piece blank according to claim 3, where in said first, second, and third interchangeable panels are integrated as a second bottom panel of bottom tray, foldably overlapped on top of said first bottom panel of bottom tray; said fourth interchangeable panel folded to become a front side wall of said back leg; said fifth, sixth, and seventh panels folded to become a third, fourth, and fifth closing flap of said back leg respectively.

5. The one piece blank according to claim 3, where in said first interchangeable panel folded to become a front side of front wall; said second interchangeable panel folded to become a back side of front wall; said third, fourth, and fifth interchangeable panels integrated as a second bottom panel of said bottom tray, foldably over-lapped on top of said first bottom panel of bottom tray; said sixth interchangeable panel folded to become a front side wall of said back leg; said seventh exchangeable panel folded to become a third closing flap of back leg.

6. The one piece blank according to claim 3, wherein said first interchangeable panel folded to become a front side panel of a closing lid; said second, third, fourth, and fifth interchangeable panels integrated as a top panel of said closing lid; said top panel of said closing lid, foldably over-lapped on top of said second section of top panel covering back leg said sixth interchangeable panel folded to become a second back wall of said back leg; said seventh panel folded to become a third closing flap of said back leg.

* * * * *